United States Patent [19]

Endo et al.

[11] Patent Number: 4,846,057

[45] Date of Patent: Jul. 11, 1989

[54] SCREEN PRINTING MACHINE WITH WASTE PRINTING PLATE DISCHARGE MEANS

[75] Inventors: Toshio Endo, Shiroishi; Takashi Miyagi, Miyagi; Mitsuo Sato, Miyagi; Hironobu Takasawa, Miyagi; Hiroshi Kanno, Shiroishi; Keiichi Miyakawa; Masao Takano, both of Miyagi; Tomoya Ito, Sendai, all of Japan

[73] Assignee: Ricoh Co., Ltd., Tokyo, Japan

[21] Appl. No.: 91,877

[22] Filed: Sep. 1, 1987

[30] Foreign Application Priority Data

Sep. 9, 1986 [JP] Japan ..... 61-138678
Sep. 17, 1986 [JP] Japan ..... 61-220481

[51] Int. Cl.[4] ..... B41L 13/06

[52] U.S. Cl. ..... 101/120; 101/477; 100/216

[58] Field of Search ..... 101/116–120, 101/131, 132, 132.5, 141, 142; 400/227.1; 100/45, 216, 245, 217, 240; 271/200, 198

[56] References Cited

U.S. PATENT DOCUMENTS

| | | | |
|---|---|---|---|
| 52,275 | 1/1866 | Dummer | 100/245 |
| 874,306 | 12/1907 | Cumpston | 100/216 X |
| 3,410,183 | 11/1968 | Sarka | 271/198 X |
| 3,565,004 | 2/1971 | Horstmann | 101/132 |
| 3,772,984 | 11/1973 | Karls et al. | 101/245 X |
| 4,201,128 | 5/1980 | Whitehead et al. | 100/45 |
| 4,628,853 | 12/1986 | Hasegawa et al. | 101/116 |

FOREIGN PATENT DOCUMENTS

| | | | |
|---|---|---|---|
| 128855 | 11/1978 | Japan | 271/198 |
| 113490 | 9/1981 | Japan | 101/118 |
| 11281 | 1/1984 | Japan | 101/118 |
| 152894 | 7/1987 | Japan | 101/118 |
| 733670 | 7/1955 | United Kingdom | 101/118 |

*Primary Examiner*—Clifford D. Crowder
*Attorney, Agent, or Firm*—Oblon, Spivak, McClelland, Maier & Neustadt

[57] ABSTRACT

In a screen printing machine, its printing-plate discharge unit is provided with: a pair of printing-plate discharge rollers which may approach to a peripheral surface of a plate cylinder and may also draw therefrom; and a waste-paper container for receiving a waste printing plate having been peeled from the peripheral surface of the plate cylinder. In the waste-paper container is provided a waste printing-plate compression plate which is vertically movable in the waste-paper container. The compression plate is moved up and down in the waste-paper container by means of an operation means which is provided in a position outside the waste-paper container. The compression plate compresses the waste printing plate in the waste-paper container when moved downward therein.

3 Claims, 14 Drawing Sheets

SCREEN PRINTING MACHINE WITH WASTE PRINTING PLATE DISCHARGE MEANS

BACKGROUND OF THE INVENTION

1. Field of the Invention

The present invention relates to a screen printing machine.

2. Description of the Prior Art

Hitherto, in a screen printing machine in which a stencil paper is wrapped around a plate cylinder to conduct a printing operation, after completion of the printing operation, a waste stencil paper is manually peeled from the plate cylinder to cause a machine operator to ink his hands and clothes.

In order to prevent the machine operator from inking his hands and clothes in a printing-plate discharge operation of the screen printing machine, there has been developed a method for automatically discharging the waste printing plate from the printing machine, in which method an end portion of the waste printing plate is clamped between a pair of rollers and peeled from the plate cylinder of the printing machine as such rollers are rotatably driven. In the method, the thus peeled printing plate or waste stencil paper is not individually carried to a dump yard, but deposited in a waste-paper container of the printing machine by a predetermined number of waste stencil papers. The waste-paper container is carried to the dump yard when filled with the waste stencil papers.

However, in case that the capacity of the waste-paper container is small, the waste stencil papers received in the container must be frequently removed from the container. Neglect of such frequent removal of the waste stencil papers leads to jamming of the printing machine, while such frequent removal of the waste stencil papers causes the machine operator to ink his hands and clothes.

In order to resolve the above problems, when a large-sized waste-paper container is employed in the printing machine, it is difficult to find a space for receiving such large-sized container in the vicinity of the printing machine. As a result, in this case, the waste-paper container is installed in a position spaced apart from the printing machine by a relatively long distance, to which container the waste stencil papers are carried from the printing machine through a long-transfer passage. However, such long-transfer passage is often clogged with the waste stencil papers. In addition, the large-sized waste-paper container causes an environmental problem due to a disgusting odor of a large number of the waste stencil papers deposited therein.

Further, in the above case, the waste-paper container must be cleared when filled with the waste stencil papers. However, it is cumbersome for the machine operator to monitor a filling-condition the waste-paper container. When the waste stencil papers are disorderly deposited in the waste-paper container, the container is filled with a relatively-small amount of waste stencil papers. As described above, the conventional screen printing machine suffers from many problems.

SUMMARY OF THE INVENTION

It is an object of the present invention to provide a screen printing machine enabling the machine operator to automatically peel a waste stencil paper from a plate cylinder of the printing machine without any manual-peeling operation of the waste stencil paper, in which machine the thus peeled stencil papers are orderly deposited in a relatively small-sized waste-paper container installed in the vicinity of the printing machine, to make it possible to employ a relatively-short paper-transfer passage for transferring the peeled stencil papers from the plate cylinder to the waste-paper container, whereby it is possible for the waste-paper container to receive a relatively large number of waste stencil papers which are then easily removed from the container without inking the operator's hands and clothes.

The above object of the present invention is accomplished by providing the following printing machine: In a screen printing machine comprising a printing means and a printing-plate discharge means, the improvement wherein: said printing-plate discharge means is provided with a pair of vertically-arranged printing-plate discharge rollers and a waste-paper container for receiving a waste printing plate having been peeled from a plate cylinder by means of said printing-plate discharge means; said printing-plate discharge rollers can approach to and withdraw from a surface of said plate cylinder; and said waste-paper container is provided with a compression plate for compressing said waste printing plate having been received in said waste-paper container therein, said compression plate being moved up and down by an operation means mounted outside said waste-paper container.

Namely, in the above screen printing machine of the present invention, the pair of printing-plate discharge rollers approach to the plate cylinder when the waste printing plate or stencil paper is discharged from the plate cylinder, so that an end portion of the waste stencil paper is clamped between such discharge rollers and then the waste stencil paper is peeled from the plate cylinder by the discharge rollers. The thus peeled stencil papers are sent to the waste-paper container, and then orderly deposited therein one by one under pressure exerted by the compression plate as the compression plate is moved up and down in the waste-paper container by the operation means mounted outside the waste-paper container, to make it possible to deposit therein more stencil papers than are disorderly deposited therein. The waste-paper container filled with the waste stencil papers is carried to the dump yard, and turned upside down therein so that the waste stencil papers received in the container are automatically discharged therefrom without inking the operator's hands and clothes.

In an embodiment of the screen printing machine of the present invention, the compression plate is provided with its supporting axle opposite ends of which extend outward from opposite ends of the compression plate so that the supporting axle is inserted into vertical slots provided in side plates of the waste-paper container so as to be slidable along the slots. A downward movement of the compression plate in the waste-paper container is conducted by a force of gravity acting on the compression plate itself, while an upward movement of the compression plate is conducted as a swinging arm, which is swingably mounted outside the waste-paper container while brought into contact with the supporting axle of the compression plate when the swinging arm is swung upward, is swung upward. Consequently, an external force is only required to swing the swinging arm upward. In other words, compression of the waste stencil papers received in the waste-paper container is conducted only by the force of gravity acting on the compression plate.

In addition, in the embodiment of the screen printing machine of the present invention, the supporting axle of the compression plate is provided with an actuator in a traveling path of which is provided a switch which is actuated by the actuator. When the waste-paper container is filled with the waste stencil papers to prevent the compression plate from moving downward so as to make it impossible to operate the switch by the actuator, such condition of the waste-paper container is automatically reported to the machine operator through a control circuit for monitoring the waste-paper container so that the machine operator is freed from the monitoring of the waste-paper container.

DESCRIPTION OF THE PREFERRED EMBODIMENTS

The present invention will be hereinbelow described in detail with reference to the drawings.

Figure 1:
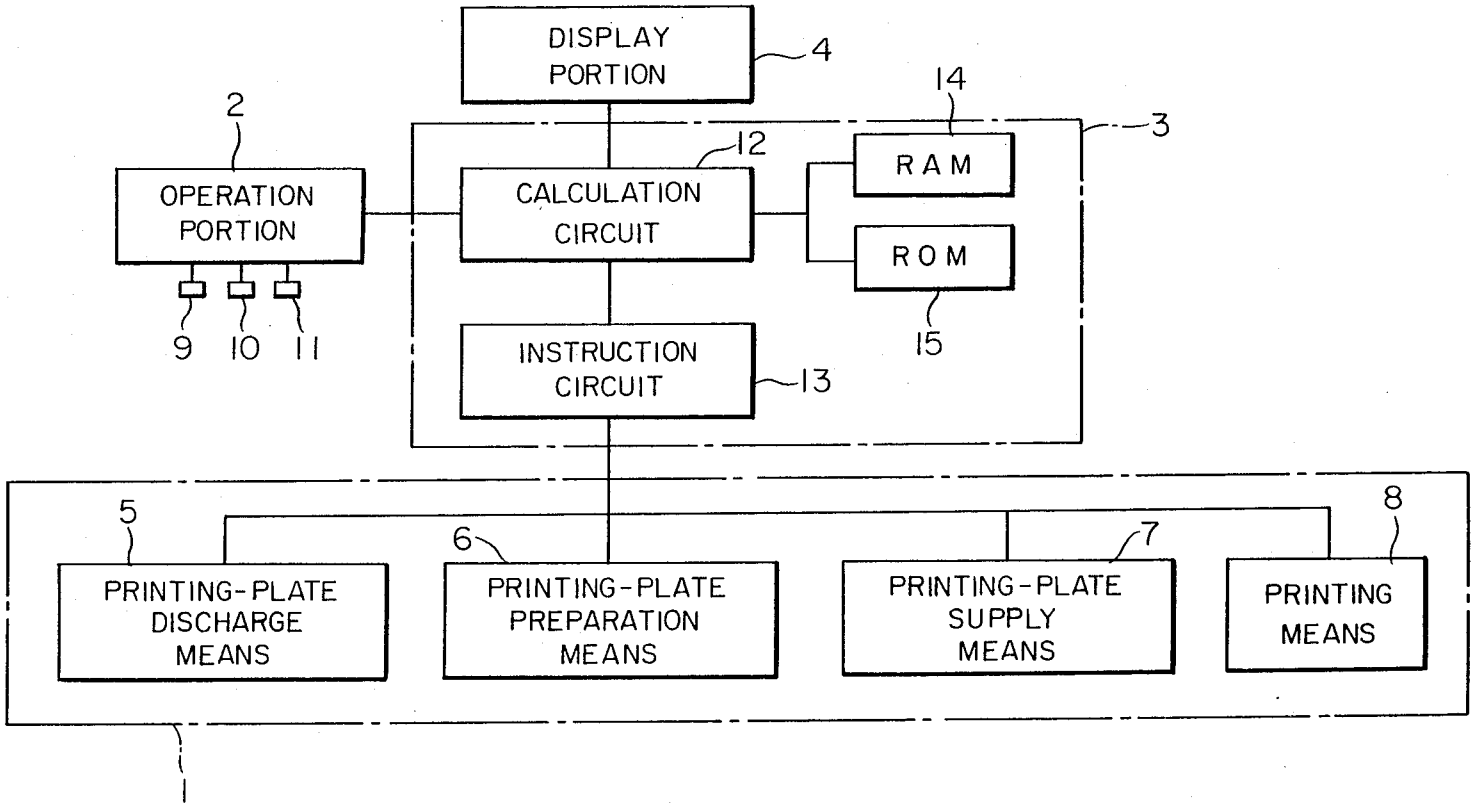
FIG. 1 is a block diagram of an embodiment of the screen printing machine of the present invention.

As shown in FIG. 1, in an embodiment of the screen printing machine of the present invention: the reference numeral 1 denotes a printing portion of the printing machine; 2 an operation portion; 3 a control portion; and 4 a display portion of the printing machine. The printing portion 1 of the printing machine of the present invention is provided with: a printing-plate discharge means 5; a printing-plate preparation means 6; a printing-plate supply means 7; and a printing means 8. The operation portion 2 of the printing machine is provided with operation keys such as: a cluster of 10-numeric keys 9; a start key 10; a security or secret key 11; and like keys. The control portion of the printing machine is provided with a micro computer comprising: a calculation circuit 12; an instruction circuit 13; a random access memory (RAM) 14; and a read only memory (ROM) 15.

In operation, a manuscript is first set on a manuscript-setting portion (not shown) of the screen printing machine of the present invention having the above construction, and thereafter a necessary number of printing papers to be printed is inputted to the printing machine by means of the 10-numeric keys 9 of the operation portion 2 of the printing machine. Then, the start key 10 is depressed to enable the instruction circuit 13 of the micro computer of the printing machine to issues necessary instruction signals to each of the printing-plate discharge 5, preparation 6 and supply 7 means, and the printing means 8, so that a necessary printing work is automatically conducted.

When a stencil paper for screen printing has been already prepared in the printing machine, it is possible to obtain printed matters by the use of such prepared stencil paper only by depressing the start key 10 of the printing machine, without setting a manuscript on the manuscript-setting portion of the printing machine.

Now, will be described a security of secret operation of the printing machine of the present invention.

Figure 2:
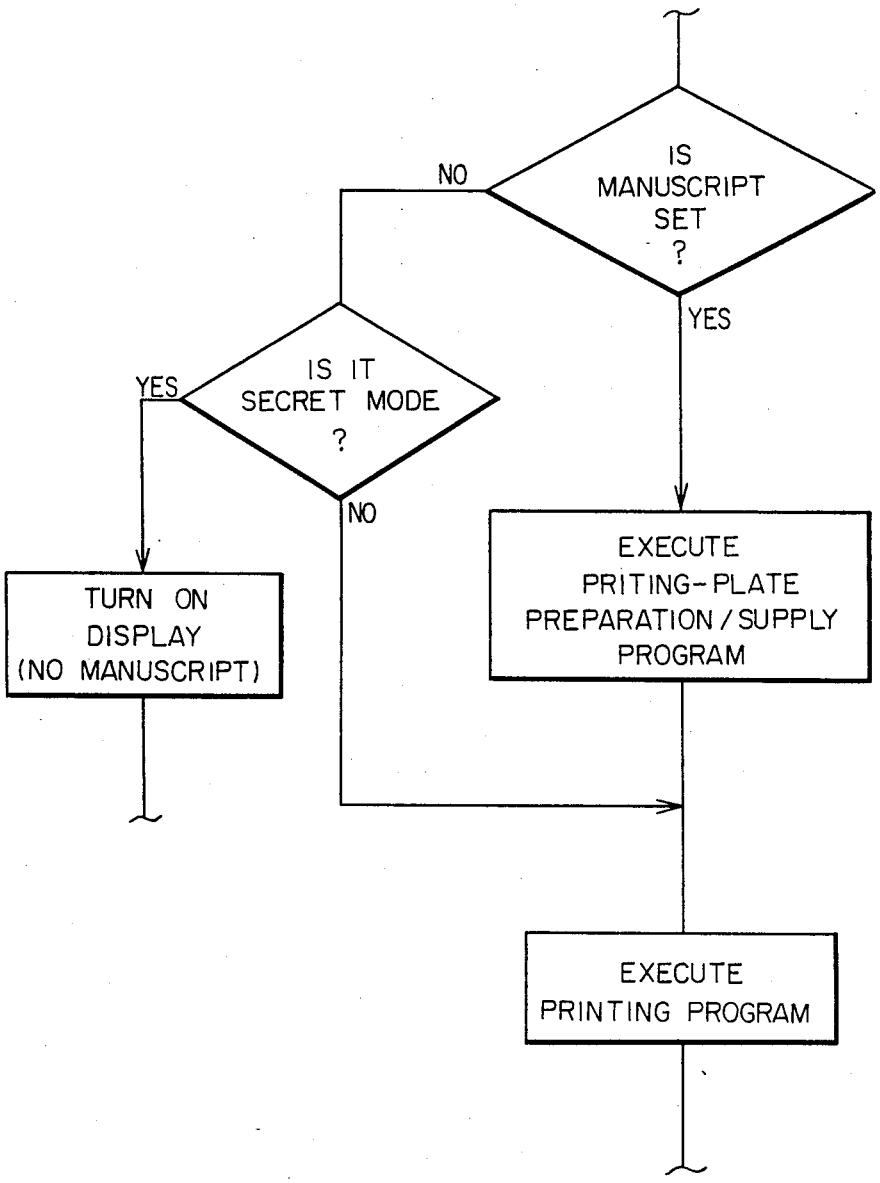
FIG. 2 is a block flowchart of a program for a control portion of the printing machine of the present invention, shown in FIG. 1.

In order to enable the printing machine to conduct such secret operation, a program executed according to a block flowchart shown in FIG. 2 is incorporated within the control portion 3 of the printing machine of the present invention.

The security or secret key 11 of the operation portion 2 of the printing machine is operated by a machine operator when the machine operator wants to make a secret of the contents of the above printed matter. When the security or secret key 11 is operated, the calculation circuit 12 of the control portion 3 of the printing machine is actuated to issue a security mode or secret mode instruction signal to the random access memory (RAM) 14 so that a secret mode instruction data is stored in the memory 14 which may be constructed of, for example such as a non-volatile memory or a volatile memory coupled with a battery for keeping a data read in the volatile memory alive even when an electric power switch of the printing machine is turned off.

As shown in FIG. 2, in case that such secret mode instruction data has been stored in the random access memory (RAM) 14, the printing program can not be executed, except when another manuscript is set on the manuscript-setting portion of the printing machine. In other words, the printing machine is released from the secret mode by setting another manuscript on the manuscript-setting portion of the printing machine. When another manuscript is set on the manuscript-setting portion of the printing machine and the above-mentioned normal operation necessary for starting the printing work of the printing machine is conducted by the machine operator, a used printing plate or stencil paper for which was required the security or secret is automatically discharged from the printing machine to make it possible to automatically start preparation, supply and printing works of a new printing plate prepared from the another manuscript.

Consequently, in the screen printing machine of the present invention, it is not necessary for the machine operator to separately conduct a discharging operation of the waste printing plate of which the machine operator should make a secret at a time when another stencil paper or printing plate is mounted on the plate cylinder of the printing machine.

Figure 3:
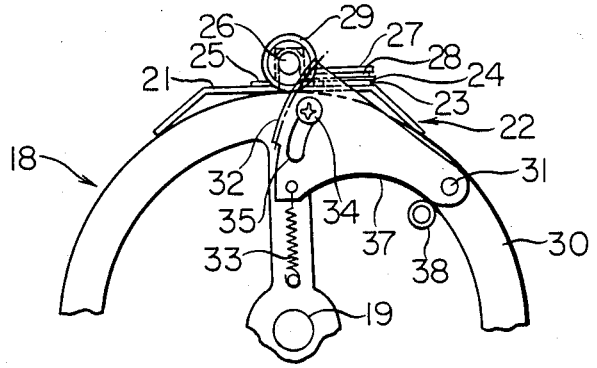
FIG. 3 is a partial side view of a plate cylinder of the printing machine of the present invention.
Figure 4:
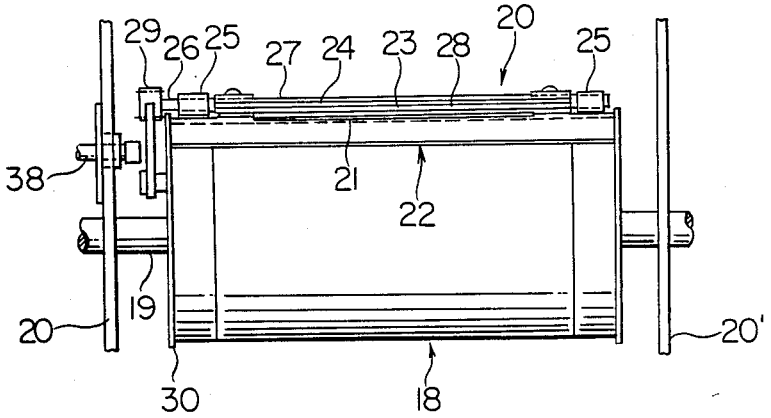
FIG. 4 is a front view of the plate cylinder of the printing machine of the present invention, shown in FIG. 3.
Figure 5:
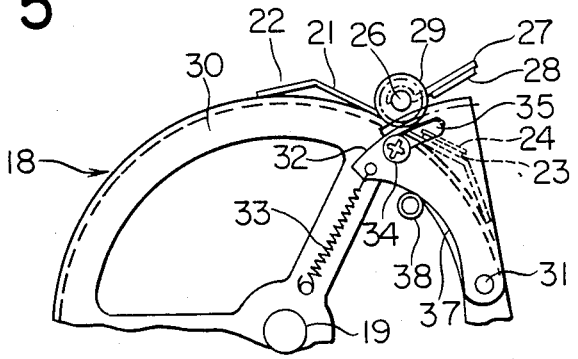
FIG. 5 is a partial side view of the plate cylinder similar to that shown in FIG. 3, in a condition in which it is not clamped.

In FIGS. 3 to 5, there is shown a preferred embodiment of the plate cylinder of the printing machine of the present invention.

In the drawings, the reference numeral 18 denotes a cylinder body of the plate cylinder, which body 18 is rotatably supported by machine frame 20, 20' through a supporting axle 19. On an outer peripheral surface of the cylinder body 18 of the plate cylinder is mounted a seat plate 22 provided with a flat portion 21 extending in an axial direction of the cylinder body 18. On an upper surface of the flat portion 21 of the seat plate 22 are mounted a plurality of resilient plates 23 which are spaced apart from each other in the axial direction of the cylinder body 18. A thin plate 24 is mounted on upper surfaces of the resilient plates 23.

Bearings 25 for rotatably supporting a rotary shaft 26 are provided in the vicinities of opposite ends of the flat portion 21 of the seat plate 22. Fixed to the rotary shaft 26 is an end portion of a supporting splate 27 to a back surface of which is fixed a rubbernet or rubber magnet 28. Extended outward from a flange 30 in a vicinity of a side portion of the cylinder body 18 of the plate cylinder is an end portion of the rotary shaft 26 to which end portion is fixed a gear 29.

Fixed to the flange 30 is a pin 31 on which is rotatably mounted a base end portion of a sector gear 32 which is meshed with the gear 29 while always urged against a center of the supporting axle 19 of the cylinder body 18 by means of a tension spring 33. In order to define an upper limit of a rocking movement of the sector gear 32, a stopper pin 34 is provided in the flange 30, which pin 34 is slidably received in an arc-shaped slot 35 of the sector gear 32.

A lower end surface of the sector gear 32 forms a cam surface 37. A cam roller 38 is rotatably provided in the machine frame 20 at a position adjacent to the cam surface 37 of the sector gear 32 so as to be detachably brought into contact with the cam surface 37. As shown in FIG. 4, the cam roller 38 is biased to a position in which the cam roller 38 is disengaged from the cam surface 37 of the sector gear 32, while engaged with the cam surface 38 at a time when a solenoid (not shown) is actuated.

In a condition as shown in FIG. 3, in order to fix the printing plate or stencil paper to the plate cylinder, the above solenoid (not shown) is actuated to cause the cam roller 38 to engaged with the cam surface 37 of the sector gear 32.

Then, as shown in FIG. 3, the cylinder body 18 of the plate cylinder is rotated clockwise so that the cam roller 38 is moved along the cam surface 37 of the sector gear 32 to cause the sector gear to swing clockwise around the pin 31 against a resilient force of the tension spring 33. Such swinging motion of the sector gear 32 causes the gear 29 to turn counterclockwise so that both the rotary shaft 26 and the supporting plate 27 is also turned counterclockwise together with the gear 29. As a result, as shown in FIG. 5, the rubber magnet 28 fixed to the supporting plate 27 is disengaged from the thin plate 24 to form an opening between the rubber magnet 28 and the thin plate 24.

After that, a printing plate or stencil paper is delivered to the above opening by means of a printing-plate supply means. When a sensor provided in the printing plate supply means detects the fact that a leading end of the printing plate surely reaches the opening, the above-mentioned solenoid (not shown) is de-energized to cause the cam roller 38 to be disengaged from the cam surface 37 of the sector gear 32, so that the sector gear 32 is returned to the position shown in FIG. 3 under the influence of the resilient force of the tension spring 33, whereby the leading end of the printing plate is clamped in the opening between the rubber magnet 28 and the thin plate 24. Then, the plate cylinder is rotated counterclockwise so that the printing plate or stencil paper is wrapped around the plate cylinder.

Since the stencil paper is provided with a polyester-film surface adjacent to the rubber magnet 28, the stencil paper or printing plate is surely clamped between the rubber magnet 28 and the thin plate 24 while firmly mounted on the seat plate 22 by means of the plurality of resilient plates 23. Consequently, even if some undulation is present in the supporting plate 27 or the rubber magnet 28, the stencil paper can follow such undulation so as to be brought into a close contact with the rubber magnet 28. In addition, since the supporting plate 27 has a sufficient rigidity, it is possible to make an opening angle of the above opening between the rubber magnet 28 and the thin plate 24 small, which makes it possible to employ a small-sized clamping mechanism (24, 27, 28) in the printing machine of the present invention.

Figure 6:
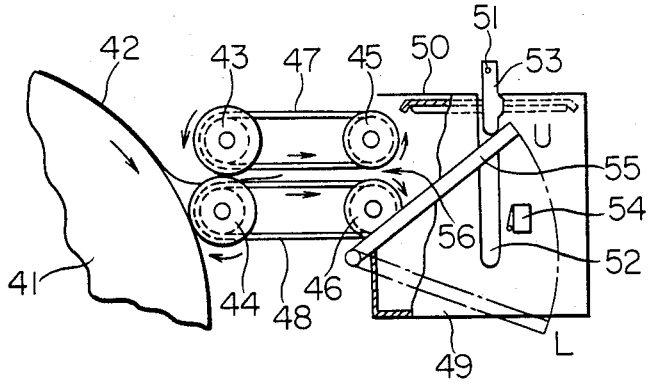
FIG. 6 is a partially broken front view of an example of a printing-plate discharge means of the printing machine of the present invention.
Figure 7:
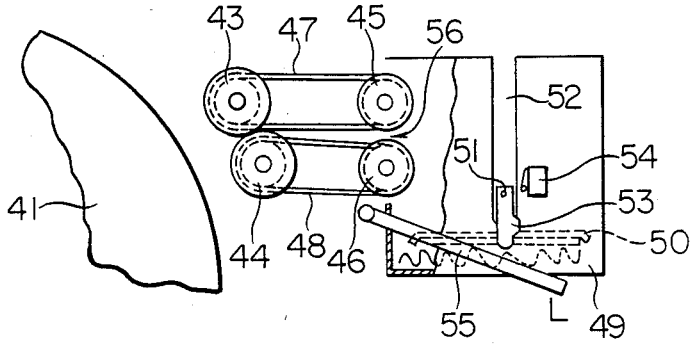
FIG. 7 is a partially broken front view of the printing-plate discharge means similar to that shown in FIG. 6, in a condition in which waste stencil papers are compressed in a waste-paper container of the printing-plate discharge means.
Figure 8:
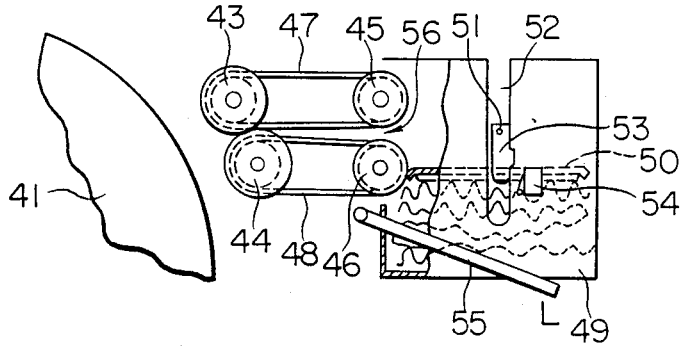
FIG. 8 is a partially broken front view of the printing-plate discharge means similar to that shown in FIG. 7, in another condition in which the waste-paper container is filled with the waste stencil papers.

In FIGS. 6 to 8, there is shown a preferred embodiment of the printing-plate discharge means of the printing machine of the present invention.

In the drawings: the reference numeral 41 denotes a plate cylinder; and 42 a printing plate or stencil paper. In the printing machine of the present invention, a pair of printing-plate discharge rollers 43, 44 are vertically arranged and abut on each other in a printing-plate discharge side of the plate cylinder 41. Spaced laterally apart from these rollers 43, 44 are a pair of sub-rollers 45, 46 which is vertically arranged in the printing-plate discharge side of the plate cylinder 41. Endless belts 47 and 48 run around theses rollers 43, 45 and 44, 46, respectively.

The sub-rollers 45, 46 are located in a side opening portion 56 of a waste-paper container 49 which is also provided with an upper opening through which a horizonally-arranged compression plate 50 is inserted into the waste-paper container 49. The compression plate 50 is provided with a horizontal axle 52 at its upper portion. The horizontal axle 52 is slidably inserted into vertical guide slots 52 provided in side walls of the waste-paper container 49 so as to be movable up and down in the guide slots 52. Opposite end portions of the supporting axle 51 are extended outward from the side walls of the waste-paper container 49 while connected with actuators 53. In the vicinity of a lower end portion of the slot 52 is provided a limit switch 54 which is operated by the actuator 53 when the actuator 53 is brought into contact with the limit switch 54 in its downward movement.

A swing arm 55 is rotatably mounted on the machine frame at its base-end portion under the sub-roller 46 while swingably driven by a suitable driving means (not shown). A free end of the swing arm 55 supports a lower end of the actuator 53.

In the printing machine having the above construction, after completion of printing work thereof, the plate cylinder 41 is rotatably driven in a direction indicated with an arrow shown in FIG. 6. At the same time, the printing-plate discharge rollers 43 and 44 are also rotatably driven in directions indicated with arrows shown in FIG. 6, respectively, while the roller 44 is urged against the plate cylinder 41 by a suitable means (not shown). As a result, the printing plate or stencil paper 42 having been wrapped around the plate cylinder 41 is clamped at its leading end, continuously peeled from the plate cylinder 41, and transferred by the lower endless belt 48 in a direction indicated with the arrow shown in FIG. 6, so that the thus peeled stencil paper 42 enters the waste-paper container 49 through the side opening portion 56 thereof. As shown in FIGS. 7 and 8, after completion of peeling of the waste stencil paper 42 from the plate cylinder 41, the printing-plate discharge roller 44 returns to its retracted position space apart from the plate cylinder 41.

When the waste stencil paper 42 is received in the waste-paper container 49, a suitable sensor (not shown) issues a signal to the above-mentioned suitable driving means (not shown) to cause the same to rotatably drive the swing arm 55 clockwise from a position "U" shown in solid lines to another position "L" shown in chain lines, as shown in FIG. 6. As a result, the actuator 53 moves downward to cause the compression plate 50 to also move downward, so that the thus received stencil paper 42 is compressed in the waste-paper container 49 by the compression plate 50 as shown in FIG. 7. After completion of such compression of the waste stencil paper 42, the swing arm 55 is turned counterclockwise to return the compression plate 50 upward to the position "U". Such return of the compression plate 50 to the position "U" is conducted at a time when the compression plate 50 does not disturb the waste stencil paper's entrance into the waste-paper container 49, and also at a time when the compression plate 50 does not disturb an installation/removal operation of the waste-paper container 49 from the printing machine. In addition, it is necessary for the waste stencil papers received in the waste-paper container 49 to be kept under pressure for a long period of time in order to increase an amount of the waste stencil papers contained in the container 49.

In the up-and-down movement of the compression plate 50 in the waste-paper container 49, the actuator 53 is engaged with the limit switch 54. After repetition of the printing plate discharge operation, when a height of a pile of waste stencil papers 42 in the waste-paper container 49 becomes higher than a level of the limit switch 54 as shown in FIG. 8, the compression plate 50 is prevented from moving downward beyond the level of the limit switch 54 by the pile of the waste stencil papers 42 in the waste-paper container 49, to make it impossible to operate the limit switch 54 by means of the actuator 53 even when the swing arm 55 is swung to the position "L" during the printing plate discharge operation.

As is clear from the above description, the limit switch 54 is provided in the side plate of the waste-paper container 49 at a level in which the container 49 is filled with the waste stencil papers 42. When the limit switch 54 is not operated by the actuator 53 in a raising operation of the actuator 53 conducted by the swing arm 55, a suitable control circuit (not shown) provided in the printing machine of the present invention warns the machine operator of the fact that the waste-paper container 49 is filled with the pile of the waste stencil papers 42, to enable the operator to remove such filled container 49 from the printing machine.

In the printing-plate discharge means 5 having the above construction, since the pile of waste stencil papers 43 is compressed in the waste-paper container 49, the container 49 can receives a large number of the waste stencil papers 42 therein. In addition, the machine operator can automatically catch the fact that the waste-paper container 49 is filled with the pile of waste stencil papers 42. Since the pile of waste stencil papers 42 is carried to the dump yard while contained in the waste-paper container 49, there is no fear that the machine operator inks his hands and clothes during a dumping operation of the waste stencil papers 42. As described above, the waste-paper container 49 is prevented from being overfilled with the waste stencil papers 42.

Figure 9:
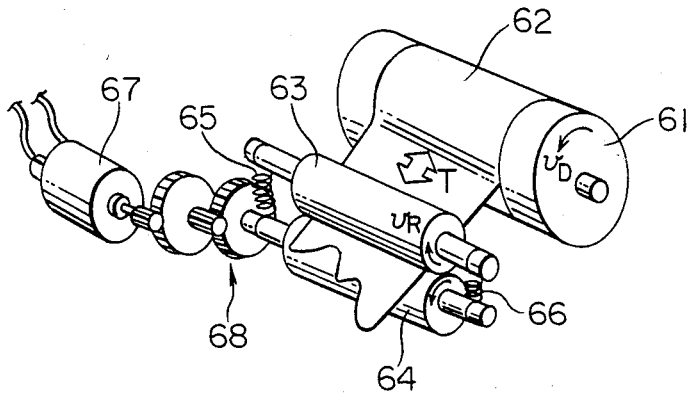
FIG. 9 is a perspective view of another example of the printing-plate discharge means of the printing machine of the present invention.

A second embodiment of the printing-plate discharge means of the printing machine of the present invention is shown in FIG. 9.

In FIG. 9: the reference numeral 61 denotes the plate cylinder; and 62 the stencil paper. A pair of printing-plate discharge rollers or pinch rollers 63, 64 are vertically arranged in a printing-plate discharge side of the plate cylinder 61 of the second embodiment of the printing-plate discharge means. These pinch rollers 63, 64 are urged against each other by tension springs 65, 66 mounted on opposite ends of their shafts, to produce an appropriate clamping force therebetween. The pinch roller 64 is driven by a motor 67 through a speed-reduction gear train 68 as shown in FIG. 9. A rotational speed of the motor 67 is automatically reduced as its load increases.

The plate cylinder 61 is driven at a peripheral speed $V_D$ by means of a suitable driving means (not shown). On the other hand, the pinch rollers 63 and 64 are driven at a peripheral speed $V_R$ in directions indicated by arrows shown in FIG. 9, respectively. After issuance of a printing-plate discharge instruction signal, when the stencil paper 62 reaches a predetermined position during rotation of the plate cylinder 61, a stencil-paper end pick-up means is actuated to guide a free end of the stencil paper 62 to a position between the pinch rollers 63, 64 so that the free end of the stencil paper 62 is clamped between the pinch rollers 63, 64, which pick-up means is disclosed in Japanese Utility Model Laid-Open No. 60-102956 which belongs to the applicants of the present application. As a result, the stencil paper 62 is peeled from the plate cylinder 61 as the pinch rollers 63, 64 rotate, and transferred to the waste-paper container (not shown).

Figure 10:
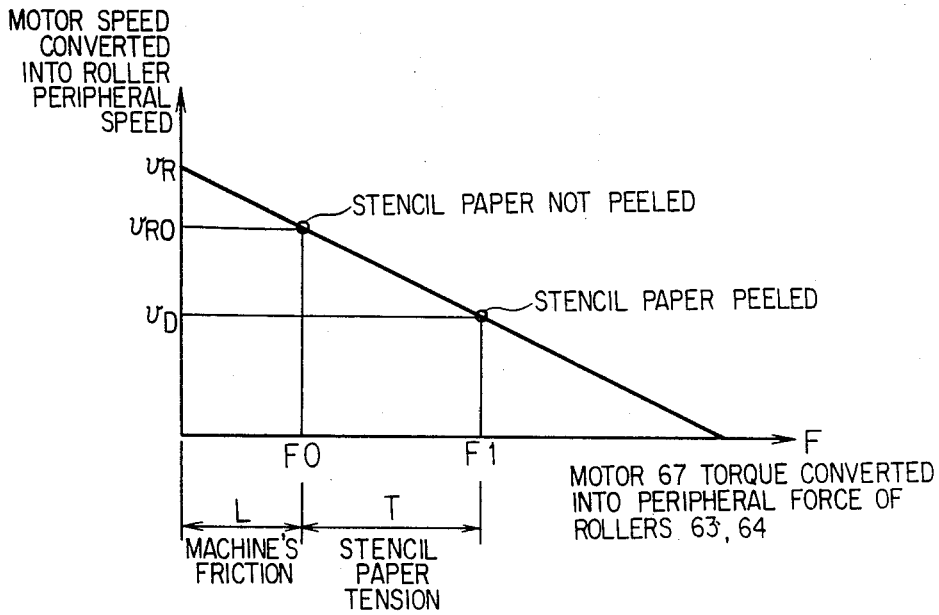
FIG. 10 is a diagram illustrating a characteristic curve of a motor employed in the printing-plate discharge means shown in FIG. 9.

When the stencil paper 62 is not clamped between the pinch rollers 63, 64, each of the pinch rollers 63, 64 rotates at a peripheral speed $V_{R0}$ with a load L which is a total frictional resistance of movable components such as the gear train 68, bearings and the like. As shown in FIG. 10, the peripheral speed $V_{R0}$ is determined on the basis of an amount of the load L according to an output-characteristic curve of the motor 67, while larger than the peripheral speed $V_D$ of the plate cylinder 61.

During the peeling operation in which the waste stencil paper 62 is clamped between the pinch rollers 63, 64 and peeled from the plate cylinder 61, the pinch rollers 63, 64 try to rotate at the peripheral speed $V_{R0}$ so as to peel the waste stencil paper 62 from the plate cylinder 61 rotating at the peripheral speed $V_D$ which is smaller than the peripheral speed $V_{R0}$ of the pinch rollers 63, 64, so that a tension T is produced in the waste stencil paper 62. At this time, the above-mentioned suitable driving means (not shown) for driving the plate cylinder 61 is substantially not subjected to the tension T so that the peripheral speed $V_D$ is kept substantially constant regardless of the tension T. Consequently, as shown in FIG. 10, each of the pinch rollers 63, 64 is forced to rotate at the peripheral speed $V_D$ of the plate cylinder so that a load of the motor 67 increases to an amount of "L+T" which valances a torque F1 of the motor 67, i.e., F1=L+T, or T=F1−L. Consequently, when the peripheral speed of each of the pinch rollers 63, 64 is constant, the torque of the motor 67 and the load L are also constant. On the other hand, since the peripheral speed $V_D$ of the plate cylinder 61 is also substantially constant, the tension T produced in the waste stencil paper 62 is substantially constant to ensure a steady peeling operation of waste stencil paper 62 from the plate cylinder 61. In this case, it is necessary to keep the tension T within an allowable tensile strength of the stencil paper 62, and also necessary to prevent the tension T from overcoming the frictional force produced between the waste stencil paper 62 and the pinch rollers 63, 64, by controlling the output of the motor 67.

Figure 11:
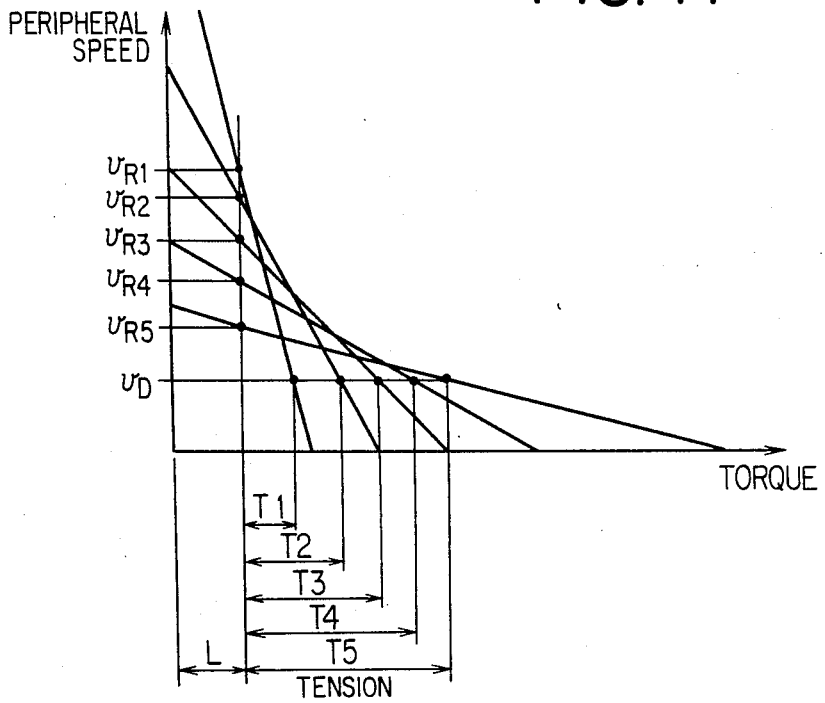
FIG. 11 is a diagram illustrating a correlation of a gear ratio of a gear train employed in the printing-plate discharge means shown in FIG. 9 with the tension in the waste stencil paper.

FIG. 11 is a diagram illustrating the correlation of the peripheral speed $V_{R1}$, $V_{R2}$, $V_{R3}$, . . . (hereinafter referred to a the peripheral speed "$V_{RN}$") with the tension T1, T2, T3, . . . (hereinafter referred to as the tension "TN") produced in the waste stencil paper 62, provided that the peripheral speed $V_{RN}$ is a peripheral speed of each of the pinch rollers 63, 64 in a condition in which the pinch rollers 63, 64 clamp no stencil paper 62. As is clear from the diagram shown in FIG. 11, the peripheral speed $V_{RN}$ decreases as the tension TN increases. Both the peripheral speed $V_{RN}$ and the tension TN are controlled by changing the gear ratio of the gear train 68.

Figure 12:
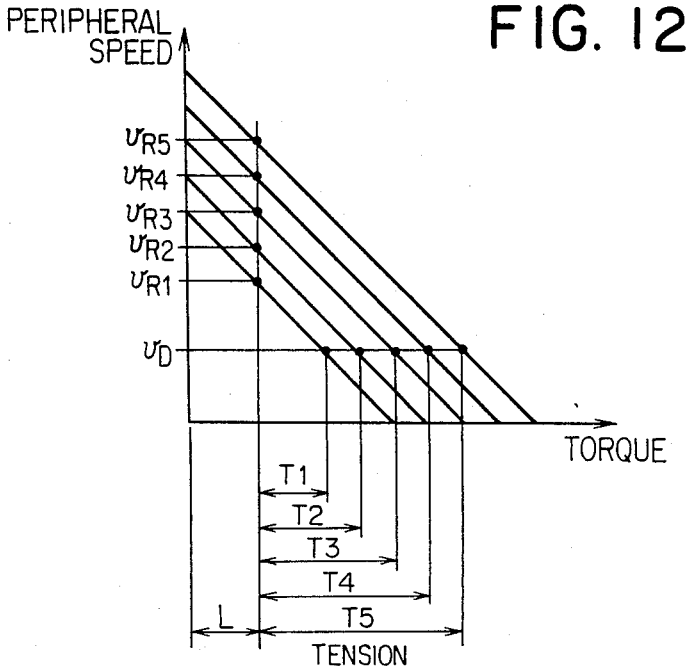
FIG. 12 is a diagram illustrating a correlation of an applied voltage of the motor shown in FIG. 9 with the tension of the waste stencil paper.

FIG. 12 is a diagram similar to that shown in FIG. 11. Both the peripheral speed $V_{RN}$ and the tension TN are controlled by changing an applied voltage of the motor 67.

Figure 13:
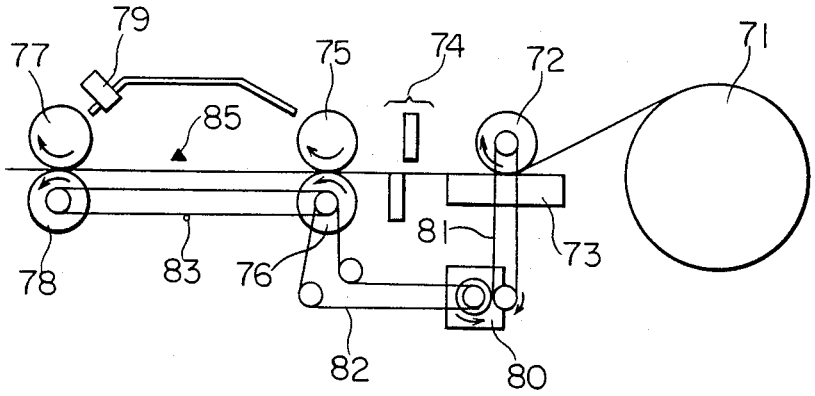
FIG. 13 is a schematic front view of a printing-plate supply means of the printing machine of the present invention.

A preferred embodiment of the printing-plate supply means 7 of the printing machine of the present invention is shown in FIG. 13.

In FIG. 13: the reference numeral 71 denotes a reel of blank stencil paper; 72 a first-feed roller between which and a thermal printhead 73 is clamped the blank stencil paper 71 to be driven by the first-feed roller 72; 74 a cutter provided behind the first-feed roller 72; 75 and 76 second-feed rollers provided behind the cutter 74, the second-feed rollers 75, 76 being meshed with each other through a suitable gear train; 77 and 78 third-feed rollers provided behind the second-feed rollers 75, 76 so as to be spaced apart from the sames 75, 76, the third-feed rollers 77, 78 being meshed with each other through a suitable gear train; 79 a deflection sensor provided in a position between the second-feed rollers 75, 76 and the third-feed rollers 77, 78; and 80 a feed-roller driving motor. This motor 80 drives the first-feed roller 72 and the second-feed roller 76 through belts 81 and 82, respectively. The third-feed roller 78 is also drive this motor 80 through the belt 82, another belt 83 and a suitable clutch means (not shown).

Figure 14:
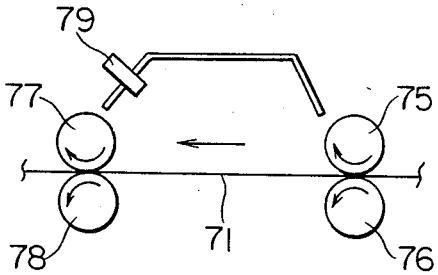
FIG. 14 is a partial front view of the printing-plate supply means shown in FIG. 13, in a condition in which it is operated.
Figure 15:
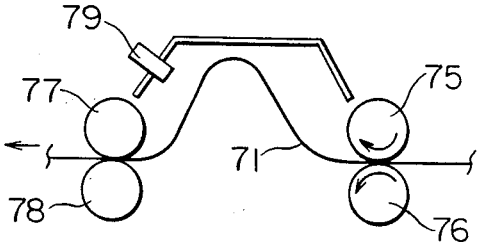
FIG. 15 is a partial front view of the printing-plate supply means shown in FIG. 13, in another condition in which it is operated.

In a preparation of the printing plate, the motor 80 rotates in a direction indicated by an arrow shown in FIG. 13 to cause all the feed rollers to rotate in directions indicated arrows shown in FIG. 13, so that the blank stencil paper 71 is delivered to the plate cylinder (not shown) as shown in FIG. 14. When a leading end portion of the thus delivered and prepared stencil paper 71 reaches the clamping mechanism (24, 27, 28) of the plate cylinder shown in FIGS. 3 to 5, such leading end portion of the prepared stencil paper 71 or printing plate is clamped by the above clamping mechanism, so that the clutch means of the third-feed rollers 78 is disengaged to make the third-feed rollers 77, 78 cease from rotating, whereby a delivery of the stencil paper 71 stops. At this time, however, the second-feed rollers 75, 76 keep rotating to keep the stencil paper 71 or printing plate being delivered. As a result, as shown in FIG. 15, the stencil paper 71 is deflected upward between the second-feed rollers 75. 76 and the third-feed rollers 77, 78.

The sensor 79 detects such deflection of the stencil paper 71 to issue a signal which actuates a main motor (not shown) for driving the plate cylinder. As a result, the plate cylinder is rotatably driven so that the deflected portion of the stencil paper 71 is fed to the plate cylinder to turn off the sensor 79, whereby the main motor is stopped to cease the rotation of the plate cylinder.

The above operation is repeatedly conducted until the preparation of printing plate or stencil paper 71 is completed.

Such printing-plate supply means of the printing machine is also disclosed in Japanese Patent Laid-Open No. 60-188265 and Japanese Utility Model Laid-Open No. 60-119536 both of which were filed in 1985 by the applicant of the present application.

Figure 16:
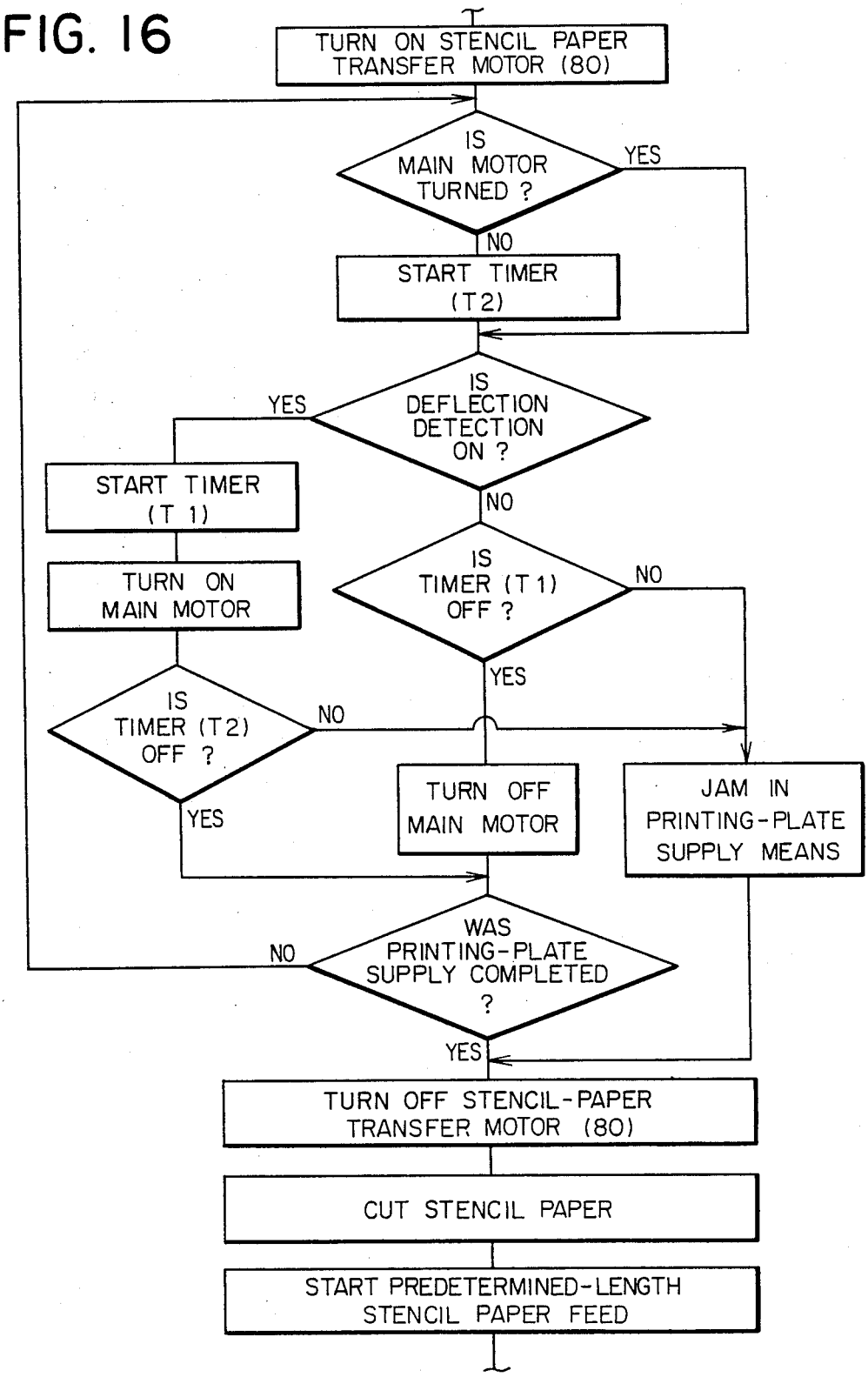
FIG. 16 is a block flowchart of the printing-plate supply means shown in FIG. 13.

In the printing-plate supply means having the above construction, in order to reduce the machine operator's work, a printing-plate jam trouble occurring therein is automatically detected according to a program having a block flowchart shown in FIG. 16, which program is incorporated within the micro computer of the control portion 3 of the printing machine of the present invention.

As for the block flowchart shown in FIG. 16, in a timer $T_1$ is set a preset-time taken for the sensor 79 to be turned on after the rotations of the third-feed rollers 77, 78 stop while the stencil paper 71 is continuously fed thereto to form a deflection portion of the stencil paper 71 in a position between the second-feed rollers 75, 76 and the third-feed rollers 77, 78. In a timer $T_2$ is set a preset-time taken for the sensor 79 to return to its off-condition after the plate cylinder rotates to withdraw the deflection portion of the stencil paper 71 from the position between the second-feed rollers 75, 76 and the third-feed rollers 77, 78.

In case that the stencil paper 71 is not clamped by the clamping means of the plate cylinder, or in case that the stencil paper 71 having been clamped by such clamping means is accidentally disengaged from the plate cylinder, the jam trouble of the printing plate or stencil paper 71 occurs. When this jam trouble is occurred in the printing-plate supply means 7 of the printing machine of the present invention, the sensor 79 can not be turned off to keep itself on even when the plate cylinder rotates. As a result, the timer $T_2$ becomes off to indicate the occurrence of the jam trouble in the printing-plate supply means 7 of the printing machine.

In case that the stencil paper 71 is accidentally cut in a position, for example between the first-feed roller 72 and the second-feed rollers 75, 76 while the leading end portion of the stencil paper 71 is clamped in the plate cylinder, the sensor 79 detects no stencil paper 71 within the preset-time of the timer $T_1$ so that the timer $T_1$ becomes off to indicate the occurrence of the jam trouble in the printing-plate supply means 7 of the printing machine.

As described above, since it is possible to detect the occurrence of the jam trouble in the printing-plate supply means 7 of the printing machine, there is not required to provide special sensors for detecting such jam trouble in the printing-plate supply means 7.

When the jam trouble occurs in the printing-plate supply means 7, the motor 80 is automatically stopped in rotation to cause the cutter 74 to cut the stencil paper 71 so that a new leading end of the stencil paper 71 is formed, and after that the motor 80 is automatically actuated again to send the new leading end of the stencil paper 71 to a position 85 shown in FIG. 13. As a result, the machine operator is freed from a setting work of the stencil paper 71 required after occurrence of the jam trouble in the printing-plate supply means 7 of the printing machine.

A preferred embodiment of the printing portion 1 of the printing machine of the present invention is shown in FIGS. 17 to 33 B.

In FIGS. 17 to 21, the reference numeral 101 denotes the plate cylinder having a porous construction, in an outer peripheral portion of which is provided the clamping means 102 for clamping the stencil paper. The plate cylinder 101 is rotatably supported by a rotary axle 103 while rotatably driven by its suitable driving unit (not shown) in a direction indicated by an arrow shown in FIG. 17. Inside the plate cylinder 101 are provided: an inking roller 104 an outer peripheral surface of which is brought into contact with an inner peripheral surface of the plate cylinder 101; and a Doctor roller 105 slightly spaced apart in micro order from the outer peripheral surface of the inking roller 104. When the inking roller 104 rotates in a direction indicated by an arrow shown in FIG. 17, an ink of an ink fountain 106 is fed to the inner peripheral surface of the plate cylinder 101.

Figure 17:
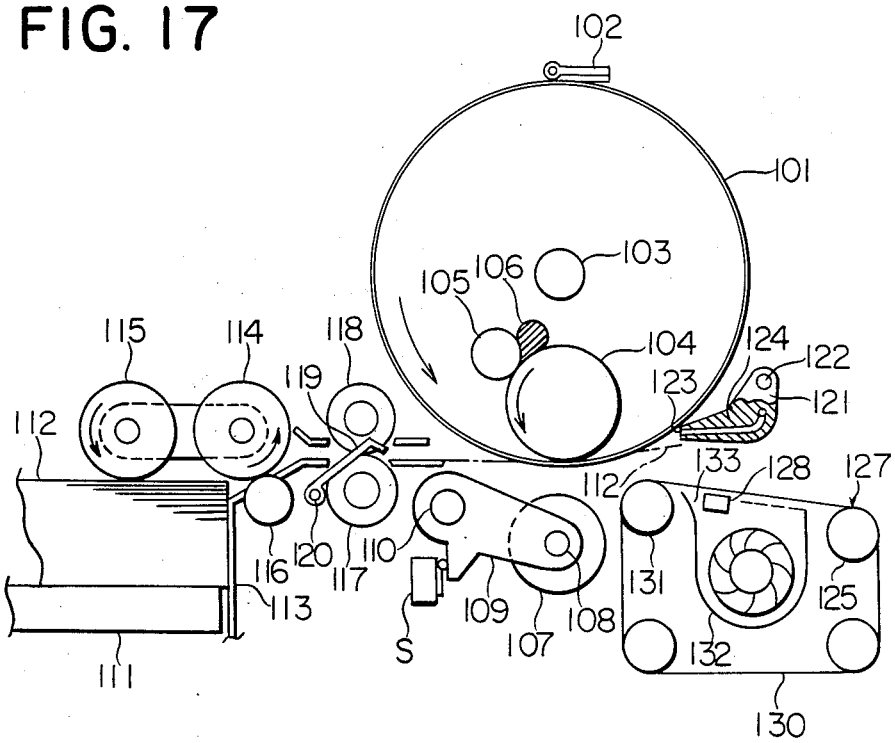
FIG. 17 is a front view of a printing means of the printing machine of the present invention.
Figure 18:
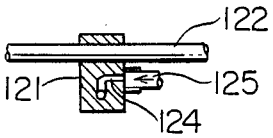
FIG. 18 is a longitudinal sectional view of a peeling nail employed in the printing means shown in FIG. 17.

Under the plate cylinder 101, there is provided an impression cylinder 107 which is detachably engaged with the plate cylinder 101 while opposite to the inking roller 104 through a peripheral wall portion of the plate cylinder as shown in FIG. 17. The impression cylinder 107 is rotatably supported by a lever 109 through a central axle 108. The lever 109 is swingably supported by the machine frame (not shown) through a central axle 110. The impression cylinder 107 intermittently swiveled around the central axle 110 between an upper position and a lower position thereof, in which upper position a blank printing paper 112 is delivered to a position between the plate cylinder 101 and the impression cylinder 107 and pressed against the outer peripheral surface of the plate cylinder 101, and in which lower position the impression cylinder 107 is disengaged from the plate cylinder 101 while synchronized in rotation with the plate cylinder 101 in order to avoid hitting the clamping means 102 of the plate cylinder 101.

A paper support 111 piled with a plurality of blank printing papers 112 is moved upward by a suitable driving means (not shown) as the printing papers 112 supported on the paper support 11 decrease. An abutment plate 113 is fixedly provided in a front end portion of the paper support 111 to regulate front end positions of the printing papers 112 on the paper support 111. Over the paper support 111, there are rotatably provided a paper-feed roller 114 and a paper-pickup roller 115 connected with the paper-feed roller 114, both of which rollers 114, 115 are made of a frictional material such as rubber and the like while rotatably driven by a suitable driving means (not shown) in directions indicated by arrows shown in FIG. 17 respectively at each time when the blank printing paper 112 is picked up from a pile of thereof on the paper support 111. At this time, the paper-feed roller 114 cooperates with a separating roller 116 adjacent to the paper-feed roller 114 to feed the uppermost one of the blank printing papers 112 on the paper support 111 to the plate cylinder 101, as shown in FIG. 17.

In a position between the paper-feed roller 114 and the plate cylinder 101, there is provided a registration-roller unit comprising a registration-driving roller 117 and a registration-follower roller 118 both of which are synchronized in rotation with the plate cylinder 101 so as to start rotating when the plate cylinder 101 reaches its predetermined rotational position, so that the blank printing paper 112 delivered from the paper-feed roller 114 is further delivered to a position between the plate cylinder 101 and the impression cylinder 107 through the registration-roller unit. In such registration-roller unit, a printing-paper detecting finger 119 is swingably supported by a central axle 120. When the blank printing paper 112 is clamped between the registration-driving roller 117 and the registration-follower roller 118 to be further delivered thereby to the plate cylinder 101, a free end portion of the detecting finger 119 is depressed by a leading end portion of the thus delivered printing paper 112 so that the detecting finger 119 is swung downward.

A peeling nail 121 for peeling the printing paper 112, which has been printed and adhered to the plate cylinder 101, from the plate cylinder 101 is oppositely disposed from the registration-roller unit through the plate cylinder 101 as shown in FIG. 17, while fixed to a central axle 112 which is synchronized in swinging operation with the the lever 109. At the same time when the impression roller 107 is pressed against the outer peripheral surface of the plate cylinder 101, a front end portion of the peeling nail 121 is brought into contact with the outer peripheral surface of the plate cylinder 101. In the front end portion of the peeling nail 121 is provided an air nozzle 123 which is connected with an air supply hose 125 through an air passage 124. The air supply hose 125 is connected with a pressurized-air source (not shown). The air supply hose 125 is provided with an on-off valve (not shown) which is controlled by a suitable control unit (not shown) so as to continuously or intermittently supply a pressurized air to peel the printed printing paper 112 from the plate cylinder 101 in the printing operation of the printing machine of the present invention. When the thus peeled printing paper 112 is detected by a detector 128 such as a photosensor and the like, the on-off valve is shut by the control unit to stop the air supply.

In FIG. 17, the reference numeral 127 denotes a sucking/transferring portion of the printing machine of the present invention, in which portion 127 a plurality of endless belts 130 run around a plurality of supporting rollers 131, and a sucking box 132 is disposed in a portion encircled with the endless belts 130. The supporting rollers 131 is rotatably driven by a suitable driving means (not shown). An upper opening of the sucking box 132 forms an air-sucking opening 133.

Figure 19:
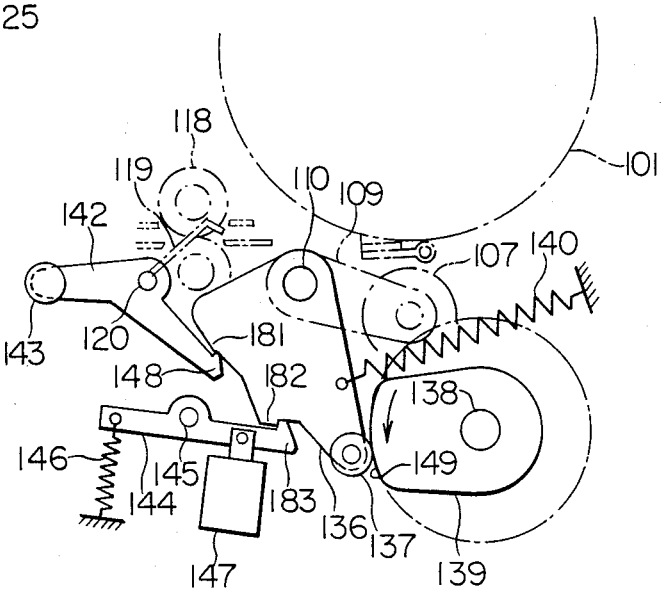
FIG. 19 is a front view of a rocking mechanism of an impression cylinder employed in the printing means shown in FIG. 17.
Figure 20:
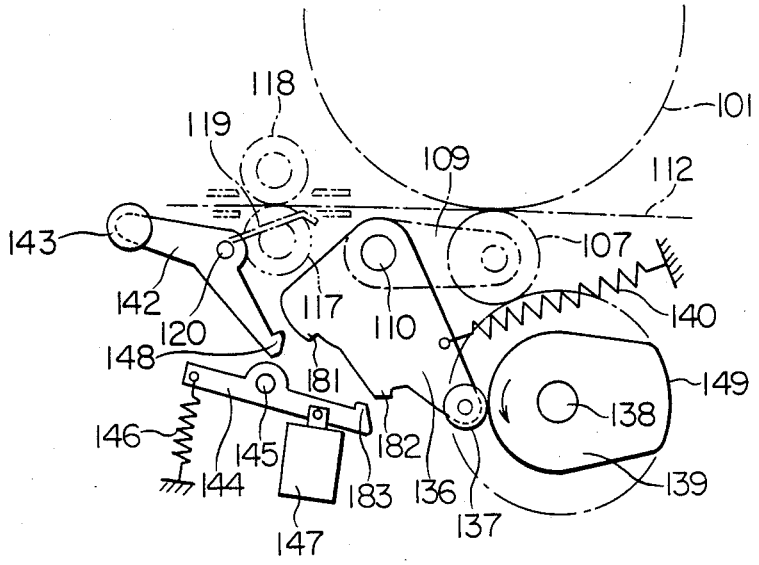
FIG. 20 is a front view of the rocking mechanism of the impression cylinder similar to that shown in FIG. 17, in a condition in which the impression cylinder engages in printing work.
Figure 21:
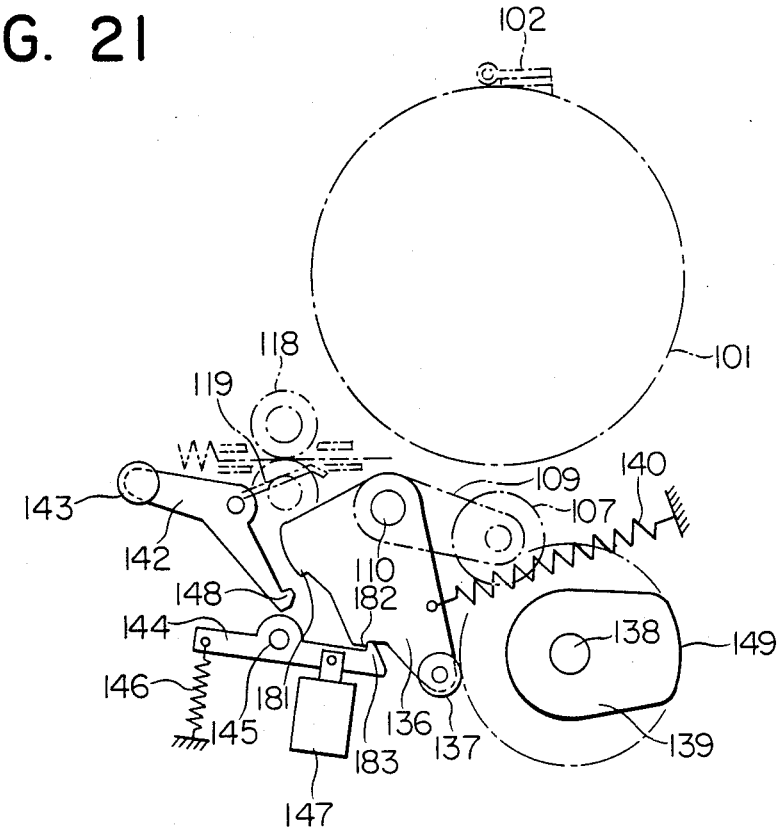
FIG. 21 is a front view of the rocking mechanism of the impression cylinder similar to that shown in FIG. 17, in another condition in which the impression cylinder is out of the printing work.

A swinging mechanism of the impression cylinder 107 has a construction shown in FIGS. 19 to 21, in which: the reference numeral 136 denotes a pressure-release arm fixed to the central axis 110 which is rotatably mounted in the machine frame. A cam follower 137 is rotatably mounted in an end portion of the pressure-release arm 137 while resiliently urged against a cam 139 fixed to a cam shaft 138 under the influence of a resilient force of a tension spring 140. In the printing operation, the cam shaft 138 is so driven that it is synchronized in rotation with the plate cylinder 101 to cause the pressure-release arm 136 to swing around the central axis 110. The reference numeral 142 denotes a paper-detecting stopper fixed to the central axle 120 which is rotatably mounted in the machine frame while swingably driven by the paper-detecting finger 119. In an end portion of the paper-detecting stopper 142 is provided a hook portion 148 which is detachably engaged with a first-hook portion 181 of the pressure-release arm 136 in a condition in which the cam follower 137 abuts on a largest-diameter portion 149 of the cam 139. In the other end portion of the paper-detecting stopper 142 is provided a weight 143 for urging an opposite end portion of the paper-detecting stopper 142 upward. Under the paper-detecting stopper 142 is provided a pressure-release stopper 144 which is rotatably supported by a central axle 145 and swings around the axle 145. An end portion of the pressure-release stopper 144 forms a hook portion 183 which is detachably engaged with the hook portion 182 of the pressure-release arm 136 in a condition in which the cam follower 137 abuts on the largest-diameter portion 149 of the cam 139. The other end of the pressure-release stopper 144 is connected with a tension spring 146 as shown in FIG. 19 to urge the hook portion 183 of the pressure-release stopper 144 upward. A portion of the pressure-release stopper 144, which is adjacent to the hook portion 183, is provided with a solenoid 147 which, in its energized condition, enables the hook portion 183 to swing downward against the resilient force of the tension spring 146 so as to be disengaged from the hook portion 182 of the pressure-release arm 136.

Figure 22:
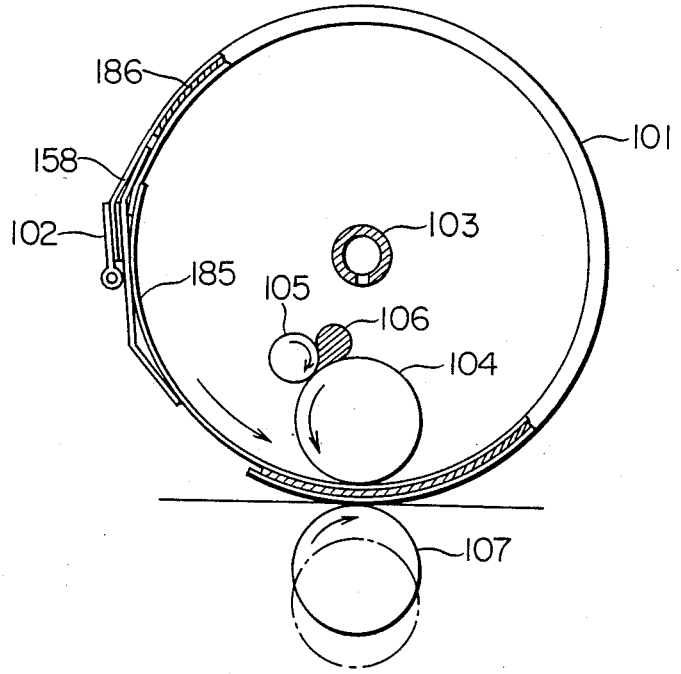
FIG. 22 is a partially broken side view of the plate cylinder and the impression cylinder shown in FIG. 17.
Figure 23:
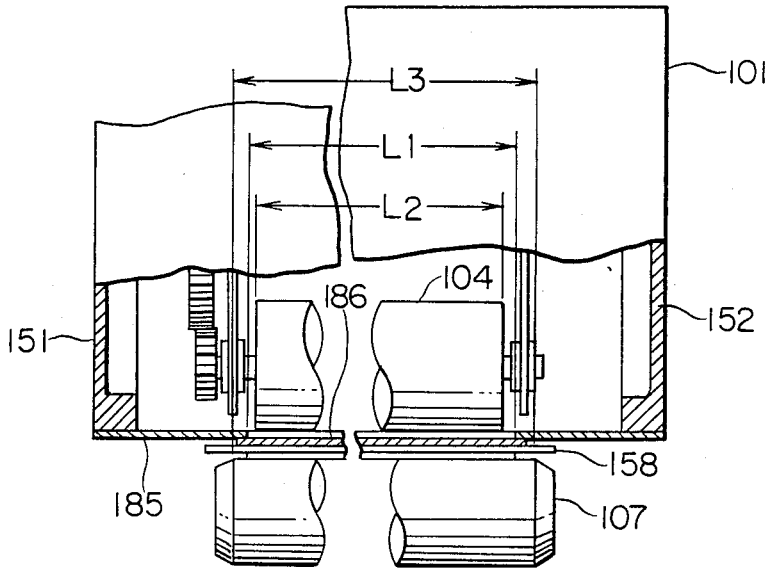
FIG. 23 is a partially broken front view of the plate cylinder and the impression cylinder shown in FIG. 22.
Figure 24:
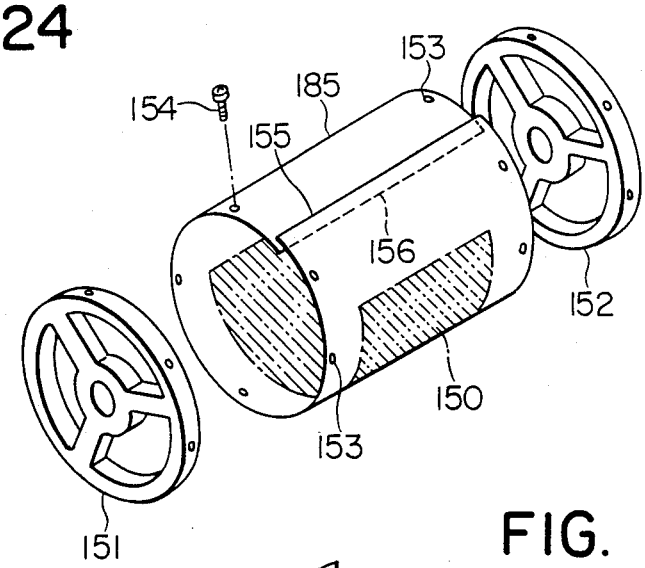
FIG. 24 is a perspective exploded view of the plate cylinder shown in FIG. 22.

As is clear from FIGS. 22 to 24, the plate cylinder 101 is constructed of a cylindrical metallic support element 185 and a screen 186 wrapped around an outer peripheral surface of the support element 185. The screen 186 is constructed of a "Tetron" fabric ("Tetron" is one of trade names of polyester) having a mesh size of from 100 to 200. As shown in FIG. 22, the cylindrical support element 185 is constructed of a thin sheet of a suitable metallic material such as a stainless steel and the like having a thickness of from about 0.01 to about 0.2 mm, which sheet is provided with a large number of pores having a diameter of about 0.5 mm formed by an etching treatment and curled into a cylindrical shape by a bending rolls machines. In FIG. 24: the reference numeral 150 denotes an ink-permeable section of the cylindrical support element 185, having a mesh size of from 20 to 60; and 151 and 152 a pair of flanges which are fixedly mounted on opposite end portions of the support element 185 through screws 154 which are threadably engaged with tiny holes 153 of the opposite end portions of the cylindrical support element 185. In preparation of the cylindrical support element 185, circumferentially-opposite end portions 155, 156 of the supporting element 185 are so secured in overlying relationship to each other that they do not hit at their corners the inking roller 104 in printing operation.

The cylindrical support element 185 having the above construction is easily manufactured at low cost while disassembled in an easy manner, and prevents any ink leakage.

Figure 25:
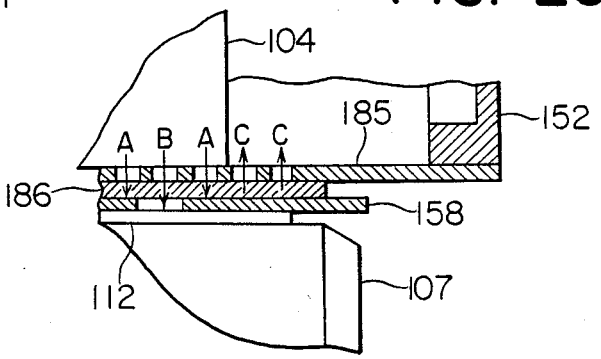
FIG. 25 is an enlarged view of essential parts of the plate cylinder and the impression cylinder shown in FIG. 23.

Now will be described an ink feed in the printing operation with reference to FIG. 25, which feed is conducted under the influence of an impression exerted by the impression cylinder 107 so that the ink is fed to the printing paper 112 through the cylindrical support element 185.

A peripheral speed of the outer peripheral surface of the inking roller 104 is smaller than that of the inner peripheral surface of the plate cylinder 101, so that the ink is forced by the inking roller 104 to enter the pores of the ink-permeable section 150 of the cylindrical support element 185 of the plate cylinder 101. After that the ink is fed to a back surface of the stencil paper 158. Namely, as indicated by an arrow "A" shown in FIG. 25, the ink fed to the inner peripheral surface of the cylindrical support element 185 from the inking roller 104 is fed to the screen 186 through the pores of the cylindrical support element 185, and then further fed to the back surface of the stencil paper 158. In a perforated portion of the stencil paper 158, the ink further passes through pores of the stencil paper 158 as indicated by an arrow "B" shown in FIG. 25 so as to be transferred to a surface of the printing paper 112, whereby a printed image is formed on the surface of the printing paper 112.

In an unperforated portion of the stencil paper 158, the ink having been fed to the screen 186 can not pass through such unperforated portion of the stencil paper 158. As a result, there seems to be a fear that the ink which can not pass through the stencil paper 158 is forced to gradually move a right-hand side in FIG. 25 under the impression exerted by the impression cylinder 107. However, as is clear from FIG. 23, an axial length L1 of the ink-permeable section 150 of the cylindrical support element 185 is longer than an axial length L2 of the inking roller 104. In addition, an axial length L3 of the impression roller 107 is longer than the axial length L1 of the ink-permeable section 150 of the cylindrical support element 185. Namely, as is clear from FIGS. 23 and 25, the ink-permeable section 150 of the cylindrical support element 185 is not covered at its opposite end portions by the inking roller 104, so that the pores of such uncovered ink-permeable section 150 of the cylindrical support element 185 permit an excess ink to be forcibly returned to the interior of the cylindrical support element 185 under the impression exerted by the impression cylinder 107 as indicated by arrows shown in FIG. 25, which prevents the leakage of the excess ink.

Figure 26:
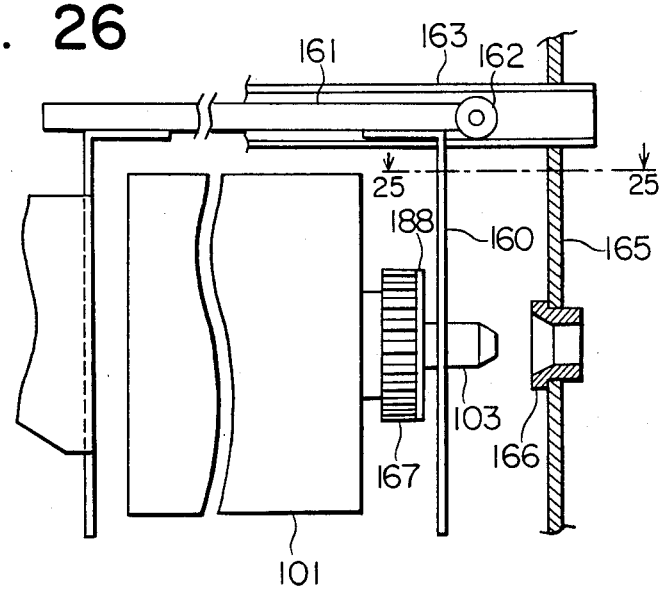
FIG. 26 is a partially broken longitudinal sectional front view of a plate-cylinder mounting portion of the printing means shown in FIG. 17.
Figure 27:
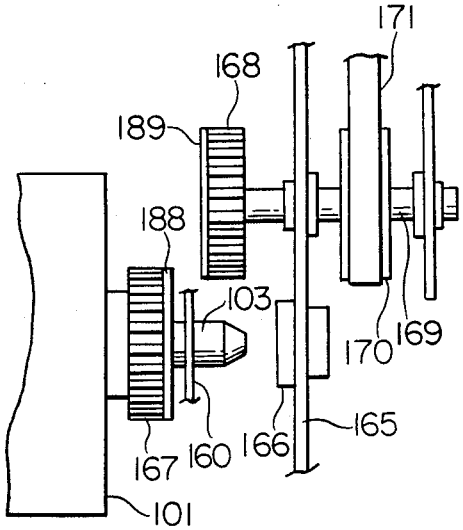
FIG. 27 is a plan view of the plate cylinder of the printing means shown in FIG. 17, taken along the line 25—25 of FIG. 26.
Figure 29:
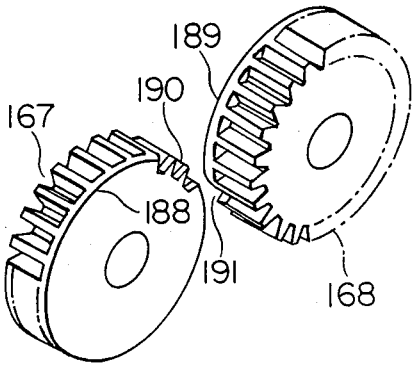
FIG. 29 is a perspective exploded view of a gear train employed in the plate cylinder shown in FIG. 27.
Figure 28:
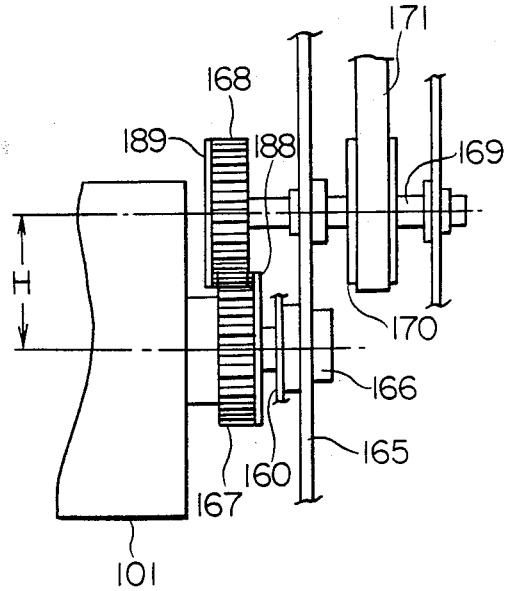
FIG. 28 is a plan view of the plate cylinder of the printing means shown in FIG. 17, after completion of assembling of the printing means.
Figure 30:
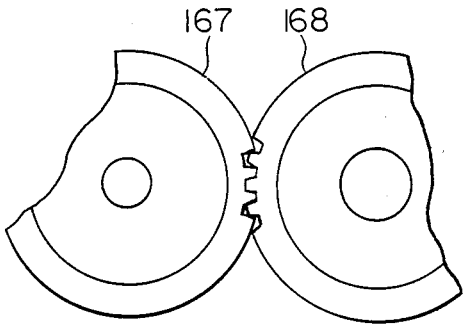
FIG. 30 is a front view of the gear train shown in FIG. 29, in meshing.

As shown in FIG. 26, the plate cylinder 101 is rotatably supported by a frame plate 160 through the rotary shaft 103, on which frame plate 160 is mounted a movable rail 161 provided with rollers 162 at its opposite end portions. The movable rail 161 can slide within a guide rail 163 in an axial direction of the plate cylinder 101, which guide rail 163 is fixedly mounted on the machine frame. A unit of the plate cylinder 101 is disengaged from the machine frame when drawn from the machine frame. A guide bush 166 fixed to the machine frame slidably guides a front end portion of the rotary shaft 103 of the plate cylinder 101 when the unit of the plate cylinder 101 is housed in the machine frame, and after that rotatably supports the rotary shaft 103. The reference numeral 167 denotes a gear fixedly connected with the plate cylinder 101, which gear 167 is therefore rotatably supported by the rotary shaft 103 which meshes with a gear 168 provided in a rotary shaft 169 which is rotatably supported by the side plate 165 of the machine frame as shown in FIG. 27. Fixedly mounted on the rotary shaft 169 is a timing pulley 170 around which and a driving pulley (not shown) runs a timing belt 171. As is clear from FIGS. 25 to 28, the gear 167 is provided with a disk-shaped flange 188 at its one end surface on the side of the frame plate 160 opposite to the plate cylinder 101, which flange 188 is provided with three gear-shaped notches 190 at its peripheral portion as shown in FIG. 29. On the other hand, as is clear from FIG. 28, the gear 168 is also provided with a disk-shaped flange 189 at its one end surface on the side of the plate cylinder 101 opposite to the side plate 165, which flange 189 is provided with four gear-shaped notches 191 at its peripheral portion as shown in FIG. 29. As shown in FIG. 28, in assembling, the gear 168 is brought into a meshing condition with the gear 167 with the use of the notches 190 and 191 when the unit of the plate cylinder 101 is housed in the machine frame. During this assembling, the axis of the gear 167 keeps being spaced apart from the axis of the gear 168 by a distance "H". Incidentally, after completion of such assembling, namely in a condition shown in FIG. 28, the flanges 188 and 189 do not interfere in rotation with the gears 168 and 167, respectively.

As is clear from the above, it is not possible to draw the unit of the plate cylinder 101 from the machine frame or to house such unit into the machine frame, except when the notches 190 of the gear 167 is axially coincident in rotation with the notches 191 of the gear 168.

Incidentally, each of the gear 167 and 168 is a 30-tooth gear with a module of 2.

Next will be described the operation of the above embodiment of the screen printing machine of the present invention.

As shown in FIG. 17, the blank printing paper 112 is delivered to the registration-roller unit one by one through the paper-feed roller 114 to reach a position between the registration-driving roller 117 and the registration-follower roller 118, in which position the printing paper 112 temporarily stops. When the plate cylinder 101 reaches in rotation a predetermined angular position, the registration-driving roller 117 begins to rotate to further deliver the printing paper 112 to the plate cylinder 101.

As a result, a leading end of the blank printing paper 112 depresses the paper-detecting finger 119. At this time, the cam follower 137 of the pressure-release arm 136 abuts on the largest-diameter portion 149 of the cam 139, and the hook portion 181 of the pressure-release arm 136 engages with the hook portion 148 of the paper-detecting stopper 142. When the paper-detecting finger 119 is depressed by the leading end of the blank printing paper 112, the finger 119 rotatably driven its central axle 120 clockwise as is clear from FIG. 19.

As a result, since the paper-detecting stopper 142 is fixed to the central axle 120, the stopper 142 is also rotatably driven clockwise so that the hook portion 148 of the stopper 142 is disengaged from the hook portion 181 of the pressure-release arm 136 as shown in FIG. 21.

At this time, as shown in FIG. 20, the solenoid 147 is also energized by means of a suitable control unit (not shown) to cause the pressure-release stopper 144 to swing around the central axle 145 clockwise, so that the hook portion 183 is also disengaged from the hook portion 182 of the pressure-release arm 136.

After that, when the plate cylinder 101 further rotates, the blank printing paper 112 is further delivered forward by the registration-driving roller 117, and the cam 139 is also rotated in a direction indicated by an arrow shown in FIG. 20 so that the cam follower 137 of the pressure-release arm 136 is freed from the largest-diameter portion 149 of the cam 139, whereby the pressure-release arm 136 is swung around the central axle 110 counterclockwise under the influence of the resilient force exerted by the tension spring 140.

When the central axle 110 rotates, since the lever 109 is fixed to the central axle 110, the lever 109 is also rotated in the same direction as that of the axle 110, to cause the impression cylinder 107 to approach the plate cylinder 101. Then, the plate cylinder 101 is further rotated so that the impression cylinder 107 is completely urged against the outer peripheral surface of the plate cylinder 101 under the influence of the resilient force exerted by the tension spring 140, whereby the printing paper 112 is clamped between the impression cylinder 107 and the plate cylinder 101 as shown in FIG. 20.

After that, the plate cylinder 101 is further rotated so that the blank printing paper 112 clamped between the impression cylinder 107 and the plate cylinder 101 is printed while transferred to the right-hand side of FIG. 20.

After completion of the printing operation of the printing paper 112, the cam 139 is further rotated so that the cam follower 137 of the pressure-release arm 136 abuts again on the largest-diameter portion 149 of the cam 139. At this time, as shown in FIG. 19, the impression cylinder 107 is disengaged from the plate cylinder 101.

Under such circumstances, if the following blank printing paper 112 is not delivered from the paper-feed roller 114, the paper-detecting finger 119 is not operated so that the central axle 20 is not rotated. Consequently, the weight 143 of the paper-detecting stopper 142 keeps the hook portion 148 of the stopper 142 engaging with the hook portion 181 of the pressure-release arm 136.

Also under such circumstances, since the solenoid 147 is not energized, the resilient force of the tension spring 146 keeps the hook portion 183 of the pressure-release stopper 144 engaging with the hook portion 182 of the pressure-release arm 136.

The plate cylinder keeps rotating until the clamping means 102 of the plate cylinder 101 reaches its uppermost position shown in FIG. 17, and stops its rotation in such uppermost position. At this time, the cam follower 137 of the pressure-release arm 136 is freed from the largest-diameter portion 149 of the cam 139. Under such circumstances, however, the impression cylinder 107 is held in a position spaced apart from the outer peripheral surface of the plate cylinder 101, because the hook portions 181 and 182 of the pressure-release arm 136 engage with the hook portion 148 of the paper-detecting stopper 142 and the hook portion 183 of the pressure-release stopper 144, respectively.

In case that the plate cylinder 101 is held stationary, it is possible to disengage the unit of the plate cylinder 101 including a unit of the inking roller 104 from the machine frame unless the impression cylinder 107 is urged against the outer peripheral surface to the plate cylinder 101.

In case that the jam trouble of blank printing paper 112 occurs when the leading end of the blank printing paper 112 depresses the paper-detecting finger 119, the hook portion 148 of the paper-detecting stopper 142 is disengaged from the hook portion 181 of the pressure-release arm 182.

Under such circumstances, due to a shortage in time, the solenoid 147 is also energized to cause the hook portion 183 of the pressure-release stopper 144 is disengaged from the hook portion 182 of the pressure-release arm 136, though it is preferable to prevent the solenoid 147 from being energized.

Under such circumstances, when both the plate cylinder 101 and the cam 139 are further rotated, the pressure-release arm 136 is swung around the central axle 110 under the influence of the resilient force of the tension spring 140 so that the impression cylinder 107 abuts on the outer peripheral surface of the plate cylinder 101 though the blank printing paper 112 is still not clamped between the plate cylinder 101 and the impression cylinder 107.

The above condition is shown in FIG. 20, provided that the printing paper 112 shown in phantom is eliminated.

Figure 32:
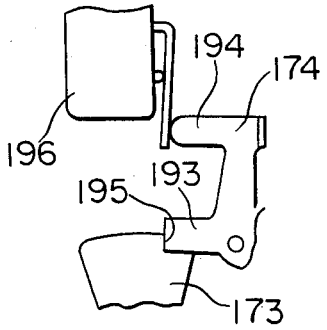
FIG. 32 is an enlarged front view of a part of the printing means shown in FIG. 31, encircled with a chain line 32.

As a result, a micro-switch 196 shown in FIGS. 17 and 32 detects the fact that the lever 109 of the impression cylinder 107 is swung around the central axle 110 counterclockwise. After that, even when, within a predetermined period of time, a detector 128 mounted in the air-sucking opening 133 of the sucking box 132 does not detect the fact that the printing paper 112 reaches the sucking/transferring portion 127, a control unit (not shown) recognizes an occurrence of the "blank-jam trouble" of the "print-jam trouble" to stop the rotation of the paper-feed roller 114, and also to stop an electrical current supply to the solenoid 147, whereby the following blank printing paper 112 is prevented from being delivered to the registration-roller unit shown in FIG. 17.

After that, in the above condition shown in FIG. 20 except the printing paper 112 shown in phantom, both the plate cylinder 101 and the cam 139 are further rotated so that the cam follower 137 of the pressure-release arm 136 abuts on the largest-diameter portion 149 of the cam 139. At this time, since the solenoid 147 is still not energized, the pressure-release stopper 144 is swung around the central axle 145 counterclockwise under the influence of the resilient force exerted by the tension spring 146 to cause its hook portion 183 to engage with the hook portion 182 of the pressure-release arm 136, through the paper-detecting finger 119 is still swung clockwise by the blank printing paper 112 jammed in the vicinity of the registration-roller unit so that the hook portion 148 of the paper-detecting stopper 142 remains disengaged from the hook portion 181 of the pressure-release arm 136.

Then, the plate cylinder 101 is further rotated to reach its predetermined angular position in which the clamping means 102 of the plate cylinder 101 reaches its uppermost position as shown in FIG. 21. In this condition, the impression cylinder 107 remains disengaged from the plate cylinder regardless the occurrence of the jam trouble of printing paper 112.

As a result, since the plate cylinder 101 stops in rotation at its predetermined angular position in which the clamping means 102 of the plate cylinder 101 is kept in its uppermost position, it is possible to easily draw the unit of the plate cylinder 101 from the machine frame even when such jam trouble occurs in the printing-paper supply means 7 or the registration-roller unit.

Namely, the jammed printing paper 112 is easily removed from the printing machine by disengaging the unit of the plate cylinder 101 from the machine frame, so that the inked impression cylinder is also easily cleaned.

The printing paper 112 has a tendency to be adhered to the outer peripheral surface of the plate cylinder 101 after printed. Consequently, it is necessary to peel the printed paper 112 from the outer peripheral surface of the plate cylinder 101 by the use of the air jet issued from the air nozzle 123 of the peeling nail 121 as shown in FIG. 17. A leading end portion of the printed paper 112 thus peeled from the plate cylinder 101 by the use of the peeling nail 121 drops under the influence of gravity. At this time, the air-sucking opening 133 sucks open air to produce a negative pressure in the vicinity of the opening 133, so that the leading end portion of the thus dropping printed paper 112 is sucked by the opening under the influence of the above negative pressure to adhere to an upper surface of the sucking box 132. As a result, the printed paper 112 is forcibly transferred to a paper-discharge station (not shown) by the endless belts 130 while urged against upper surfaces of the endless belts 130.

Figure 31:
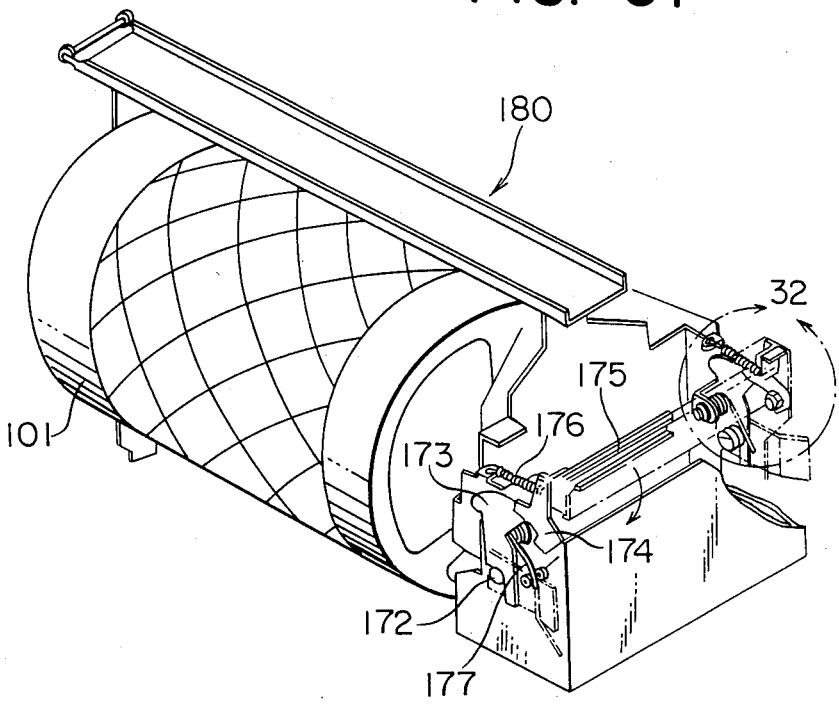
FIG. 31 is a perspective view of the printing means shown in FIG. 17, in which a unit of the plate cylinder and a machine frame thereof are assembled.
Figure 33A:
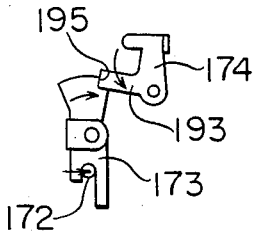
FIG. 33A is a front view of a part of the printing means shown in FIG. 31, in a condition in which a stopper is locked.
Figure 33B:
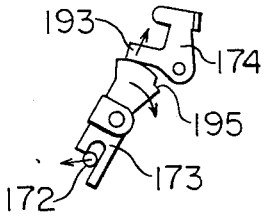
FIG. 33B is a front view of the part of the printing means similar to that shown in FIG. 33A, in another condition in which the stopper is released.

Embodiments of a locking mechanism and a detection mechanism employed in the assembling and disassembling operations of an another embodiment of a plate-cylinder unit 180 are shown in FIGS. 31 to 33.

In FIG. 31: the reference numeral 172 denotes a lock pin 172; 173 an arm; 174 a stopper; 175 a locking-release lever; 176 a tension spring; and 177 a torsional spring.

As shown in FIG. 31, when the plate-cylinder unit 180 is inserted into the machine frame, the lock pin 172 pushes the arm 173 so that the arm 173 rotates counterclockwise. As a result, a lower projection 193 of the stopper 174 engages with an upper-notch portion 195 of the arm 173 as shown in FIG. 32, so that the plate-cylinder unit 180 is locked to the machine frame. At this time, an upper projection 194 of the stopper 174 depresses an actuator of the micro-switch 196 to detect the fact that the plate-cylinder unit 180 is locked to the machine frame. When the locking-release lever 175 is pulled forward in a direction indicated by an arrow shown in FIG. 31, the stopper 174 is swung clockwise as shown in FIG. 33 B so that the arm 173 is rotated also clockwise under the influence of the resilient force exerted by the torsional spring 17, whereby the lock pin 172 is slightly pushed out of the machine frame together with the plate-cylinder unit 180. As a result, the plate-cylinder unit 180 is disengaged from the machine frame. At the same time, the actuator of the micro-switch 196 is freed from the upper projection 194 of the stopper 174 so that the fact that the plate-cylinder unit 180 is disengaged from the machine frame is detected. As described above, only when the plate-cylinder unit 180 is completely locked to the machine frame, it is detected that the plate-cylinder unit 180 is locked to the machine frame. In other words, when the plate-cylinder unit 180 is kept in a half-locking condition, the micro-switch 196 is not actuated to cause the machine operator to recognize the fact that the plate-cylinder unit 180 is not locked to the machine frame. Therefore, there is no fear that the micro-switch 196 is accidentally operated under the influence of vibrations of the printing machine during its printing operation.

Although particular preferred embodiments of the present invention have been disclosed in detail for illustrative purposes, it will be recognized that variations or modifications of the disclosed printing machine, including the rearrangement of parts, lie within the scope of the present invention.

What is claimed is:

1. A screen printing machine with printing means and waste printing-plate discharge means, said waste printing-plate discharge means including discharge rollers, a waste printing-plate container for receiving waste printing-plates peeled from a plate cylinder by said discharge rollers, a compression plate having a support shaft outwardly projecting from said compression plate and provided with a downwardly movable tendency for resting on and compressing said waste printing plates received in said waste printing-plate container, guide means for guiding said support shaft, and an operating member provided outside said waste printing-plate container for upwardly moving said compression plate against the downwardly movable tendency thereof, said operating member including a vertically rockable arm for causing upward movement of said compression plate to a position above a waste printing plate discharged into said waste printing-plate container by said discharge rollers, said waste printing-plate containers being removably received in a position to receive waste printing plates and wherein said arm is rockable downwardly to cause downward movement of said compression plate after discharge of a waste printing plate into said waste printing-plate container by said discharge rollers, said machine further comprising an actuator mounted on said support shaft, a switch provided in the path of movement of said actuator and operable when actuated by said actuator, and a control circuit for providing an alarm when said waste printing-plate container is full so that said actuator no longer actuates said switch when it is moved downwardly.

2. The screen printing machine according to claim 1, wherein said waste printing-plate discharge means further includes a pair of auxiliary discharge rollers disposed outwardly and sidewise of and facing said respective discharge rollers and endless belts each passed round each said discharge roller and each said auxiliary discharge roller, said discharge rollers being capable of being displaced toward and away from the plate cylinder surface.

3. The screen printing machine according to claim 1, wherein said means for guiding said support shaft is provided on a wall of said waste printing-plate container adjacent said support shaft.

* * * * *